US007602304B2

(12) United States Patent
Tice

(10) Patent No.: US 7,602,304 B2
(45) Date of Patent: Oct. 13, 2009

(54) MULTI-SENSOR DEVICE AND METHODS FOR FIRE DETECTION

(75) Inventor: Lee D. Tice, Bartlett, IL (US)

(73) Assignee: Honeywell International Inc., Morristown, NJ (US)

( * ) Notice: Subject to any disclaimer, the term of this patent is extended or adjusted under 35 U.S.C. 154(b) by 402 days.

(21) Appl. No.: 11/393,464

(22) Filed: Mar. 30, 2006

(65) Prior Publication Data

US 2006/0192670 A1 Aug. 31, 2006

Related U.S. Application Data

(60) Division of application No. 10/670,016, filed on Sep. 24, 2003, now Pat. No. 7,068,177, which is a continuation-in-part of application No. 10/247,106, filed on Sep. 19, 2002, now Pat. No. 6,967,582.

(51) Int. Cl.
*G08B 17/10* (2006.01)

(52) U.S. Cl. ..... 340/630; 340/584; 340/522

(58) Field of Classification Search ..... 340/630, 340/628, 578, 629, 632, 584, 589, 522, 506, 340/517, 521

See application file for complete search history.

(56) References Cited

U.S. PATENT DOCUMENTS

| | | | | | |
|---|---|---|---|---|---|
| 3,909,813 | A * | 9/1975 | Scheidweiler et al. | ..... | 340/517 |
| 3,940,753 | A | 2/1976 | Muller | ..... | 250/338.1 |
| 4,101,785 | A | 7/1978 | Malinowski | ..... | 250/574 |
| 4,112,310 | A | 9/1978 | Malinowski | ..... | 250/574 |
| 4,640,628 | A * | 2/1987 | Seki et al. | ..... | 374/141 |
| 4,680,576 | A | 7/1987 | Bauer | ..... | 340/630 |
| 5,172,096 | A | 12/1992 | Tice et al. | ..... | 340/501 |
| 5,483,222 | A | 1/1996 | Tice | ..... | 340/518 |
| 5,557,262 | A | 9/1996 | Tice | ..... | 340/587 |
| 5,568,130 | A * | 10/1996 | Dahl | ..... | 340/630 |
| 5,612,674 | A | 3/1997 | Tice | ..... | 340/517 |
| 5,659,292 | A | 8/1997 | Tice | ..... | 340/522 |
| 5,708,414 | A | 1/1998 | Peltier et al. | ..... | 340/506 |
| 5,726,633 | A | 3/1998 | Wiemeyer | ..... | 340/506 |
| 5,764,142 | A * | 6/1998 | Anderson et al. | ..... | 340/511 |
| 5,831,524 | A | 11/1998 | Tice et al. | ..... | 340/506 |
| 5,969,604 | A | 10/1999 | Tice | ..... | 340/506 |
| 6,150,935 | A | 11/2000 | Anderson | ..... | 340/506 |
| 6,222,456 | B1 * | 4/2001 | Tice | ..... | 340/630 |
| 6,229,439 | B1 | 5/2001 | Tice | ..... | 340/506 |
| 6,320,501 | B1 | 11/2001 | Tice et al. | ..... | 340/517 |
| 6,392,536 | B1 | 5/2002 | Tice et al. | ..... | 340/506 |
| 6,445,292 | B1 | 9/2002 | Jen et al. | ..... | 340/539.26 |
| 6,583,404 | B1 * | 6/2003 | Sakurai | ..... | 250/222.2 |
| 6,788,197 | B1 * | 9/2004 | Thuillard et al. | ..... | 340/522 |
| 6,879,253 | B1 * | 4/2005 | Thuillard | ..... | 340/526 |
| 2004/0090335 | A1 * | 5/2004 | Pfefferseder et al. | ..... | 340/600 |

FOREIGN PATENT DOCUMENTS

| | | |
|---|---|---|
| JP | 08-263762 | * 10/1996 |

* cited by examiner

*Primary Examiner*—Daniel Previl
(74) *Attorney, Agent, or Firm*—Husch Blackwell Sanders Welsh & Katz

(57) ABSTRACT

Multiple parameter fire detection uses outputs from one or more radiant energy sensors in combination with outputs from smoke or thermal sensors to shorten response times to alarm while minimizing nuisance alarms. The radiant energy related outputs can be used to alter parameters of the smoke or thermal sensors. The various sensors can be displaced from one another in an alarm system.

11 Claims, 3 Drawing Sheets

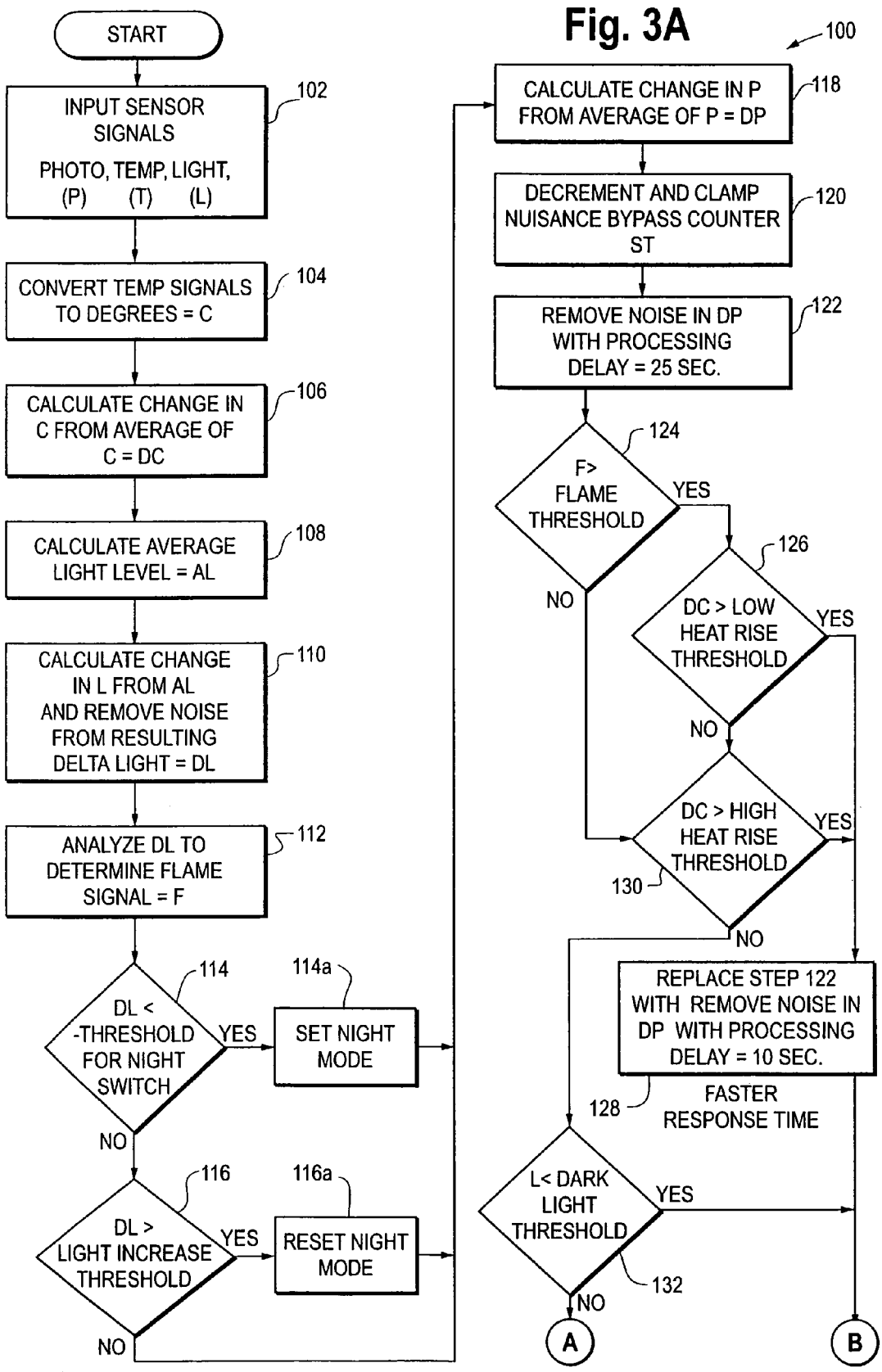
Fig. 3A
100
START
INPUT SENSOR SIGNALS
PHOTO, TEMP, LIGHT,
(P) (T) (L)
102
CONVERT TEMP SIGNALS TO DEGREES = C
104
CALCULATE CHANGE IN C FROM AVERAGE OF C = DC
106
CALCULATE AVERAGE LIGHT LEVEL = AL
108
CALCULATE CHANGE IN L FROM AL AND REMOVE NOISE FROM RESULTING DELTA LIGHT = DL
110
ANALYZE DL TO DETERMINE FLAME SIGNAL = F
112
DL < -THRESHOLD FOR NIGHT SWITCH
114
YES
SET NIGHT MODE
114a
NO
DL > LIGHT INCREASE THRESHOLD
116
YES
RESET NIGHT MODE
116a
NO
CALCULATE CHANGE IN P FROM AVERAGE OF P = DP
118
DECREMENT AND CLAMP NUISANCE BYPASS COUNTER ST
120
REMOVE NOISE IN DP WITH PROCESSING DELAY = 25 SEC.
122
F> FLAME THRESHOLD
124
YES
NO
DC > LOW HEAT RISE THRESHOLD
126
YES
NO
DC > HIGH HEAT RISE THRESHOLD
130
YES
NO
REPLACE STEP 122 WITH REMOVE NOISE IN DP WITH PROCESSING DELAY = 10 SEC.
128
FASTER RESPONSE TIME
L< DARK LIGHT THRESHOLD
132
YES
NO
A
B

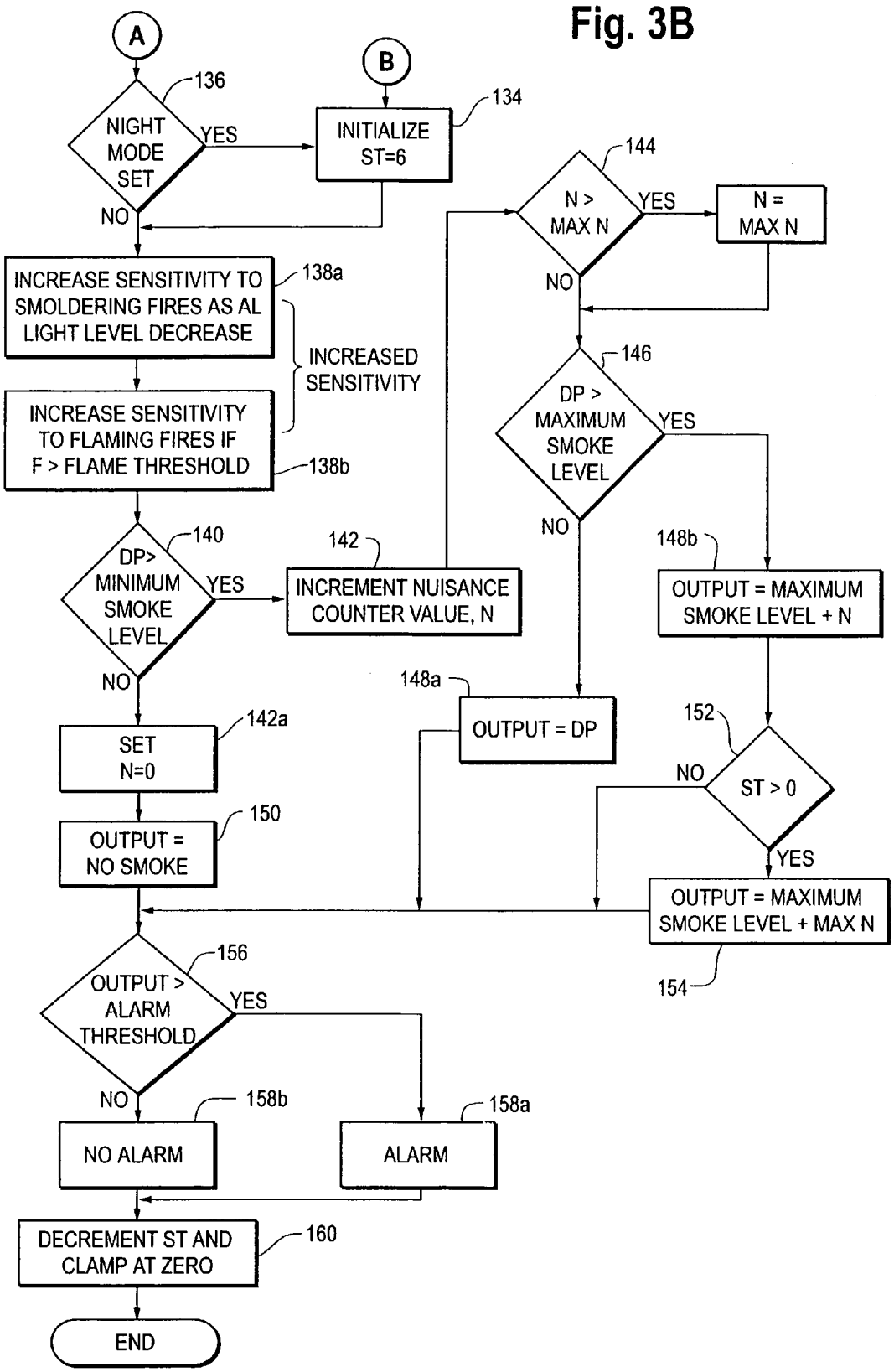
Fig. 3B
A
B
136
NIGHT MODE SET
YES
NO
134
INITIALIZE ST=6
138a
INCREASE SENSITIVITY TO SMOLDERING FIRES AS AL LIGHT LEVEL DECREASE
INCREASED SENSITIVITY
INCREASE SENSITIVITY TO FLAMING FIRES IF F > FLAME THRESHOLD
138b
140
DP> MINIMUM SMOKE LEVEL
YES
NO
142
INCREMENT NUISANCE COUNTER VALUE, N
142a
SET N=0
150
OUTPUT = NO SMOKE
144
N > MAX N
YES
NO
N = MAX N
146
DP > MAXIMUM SMOKE LEVEL
YES
NO
148b
OUTPUT = MAXIMUM SMOKE LEVEL + N
148a
OUTPUT = DP
152
ST > 0
NO
YES
OUTPUT = MAXIMUM SMOKE LEVEL + MAX N
154
156
OUTPUT > ALARM THRESHOLD
YES
NO
158b
NO ALARM
158a
ALARM
DECREMENT ST AND CLAMP AT ZERO
160
END

MULTI-SENSOR DEVICE AND METHODS FOR FIRE DETECTION

CROSS REFERENCE TO RELATED APPLICATION

This is a Divisional of U.S. patent application Ser. No. 10/670,016 filed Sep. 24, 2003 now U.S. Pat. No. 7,068,177 entitled "Multi-Sensor Device and Methods for Fire Detection" which is a Continuation-In-Part of U.S. patent application Ser. No. 10/247,106 filed Sep. 19, 2002 now U.S. Pat. No. 6,967,582 entitled "Detector with Ambient Photon Sensor and Other Sensors".

FIELD OF THE INVENTION

The invention pertains to fire detection. More particularly, the invention pertains to systems and methods of fire detection using signals from multiple, different types of sensors.

BACKGROUND OF THE INVENTION

It has been known that a sensitivity parameter of a smoke detector can be periodically altered in response to day/night cycles. The known sequence increases the sensitivity at night and decreases it during the day. Such changes can be effected automatically in response to incident light.

At times there is continued light in a region even at night. Hence, it would be desirable to be able to respond to more than the level of ambient light in changing sensitivity. Additionally, if the light being sensed is from a developing fire condition, it would be desirable to take that information into account in making a fire determination. It would also be advantageous if information obtained from the light sensor could be used to speed up the fire detection process and/or minimize nuisance alarms.

BRIEF DESCRIPTION OF THE DRAWINGS

FIGS. 3A, 3B taken together are steps of an exemplary processing method in accordance with the invention.

DETAILED DESCRIPTION OF THE EMBODIMENTS

Figure 1A:
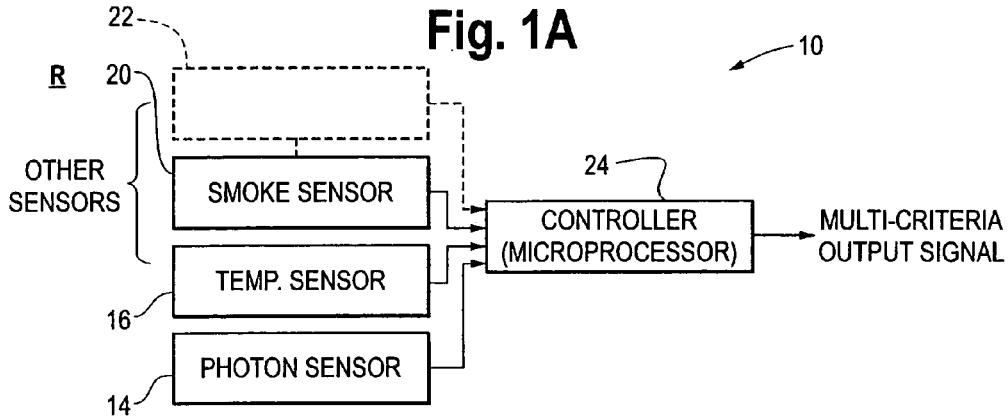
FIG. 1A is a block diagram of an exemplary system in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

In one embodiment of the invention, a sensor of radiant energy, such as a photodiode, thermopile, pyro-electric, passive infrared sensor or other type of flame sensor can be used to monitor a region. The sensor generates an electrical signal which corresponds to incident radiant energy or light. Where the light is produced by a flaming fire, the electrical signal fluctuates accordingly.

The radiant energy sensor can be used in combination with sensors of other hazardous conditions, such as smoke, temperature or gas to provide improved multiple criteria determinations of alarm conditions. The radiant energy sensor can be in a common housing with the other sensors. Alternately, one or more of the sensors can be physically displaced from the others without departing from the spirit and scope of the present invention.

Signals from the radiant energy sensor can be monitored by either a local or a displaced processor. Where the signals from the radiant energy change from a non-fire signature, for example, a non-fluctuating or slowly changing state, to a fluctuating state consistent with a fire signature, the detected change can be used to alter operational characteristics of one or more of the other sensors such as the smoke or thermal sensor. One form of such processing is disclosed in the parent application hereto Ser. No. 10/247,106 filed Sep. 19, 2002 entitled "Detector with Ambient Photon Sensors and Other Sensors" and incorporated herein by reference.

In yet another aspect of the invention, the recognized presence of a fire signature in the electrical signal from the radiant energy sensor(s) can be used to enhance or speed up detection of the fire using a thermal sensor. For purposes of minimizing nuisance alarms, signals from the thermal sensor can be enhanced on a progressive basis in response to detecting a predetermined minimal heat increase. If the thermal sensor is not detecting the minimal level of increased heat within a predetermined period of time, progressive enhancement of the signals or operation of the thermal sensor can be terminated.

By using the signals from the radiant energy sensor to establish the presence of a fire signature in the region, it may be possible to detect a small flaming fire which initially will not be generating substantial amounts of heat, as would be detected by the thermal sensor. Even if the flames should be out of the direct view of the radiant energy sensor, they may be partly visible by reflections off of surfaces or walls in the region prior to coming directly into the monitoring field of the radiant energy sensor.

Enhancement of the thermal sensor's signals can be accomplished using a counter which starts incrementing its count in response to a recognized fire signature or a recognized flaming condition. This recognition can be based on signals from the radiant energy sensor. The counter value can be used as a level shifter or multiplying factor relative to signals from the thermal sensor to obtain pre-sensitivity.

The rate at which the counter is incremented can be predetermined, or varied, depending on the signals from the radiant energy sensor, for example. Potential nuisance alarms can be limited or suppressed by clamping the degree of enhancement to a predetermined maximum value.

Fire profiles or amplitudes of signals or other characteristics of the signals from the radiant energy sensor can be used to alter the rate of increasing enhancement of the thermal sensor. Hence, a minimal fire signature from the radiant energy sensor could provide a smaller degree of enhancement than a larger version of such a signal.

In yet another aspect of the invention, the sensors can be in communication, via a wired or wireless medium, with a common control element which carries out some or all of the processing.

In yet another aspect of the invention, flame or fire indicating signals from a radiant energy sensor can be used to alter a sample rate or sensitivity parameter, or both, of a smoke detector, such as photoelectric smoke detector. Similar performance variations can be implemented with ionization-type smoke sensors.

The signals from a radiant energy sensor will also reflect abrupt or step changes in ambient light level in the region. For example, if lights in the region are abruptly switched off, signals from the radiant energy sensor will reflect this change of state. In response thereto, sample rates, or sensitivity levels or both, can be adjusted. In such circumstances, the sample rate could be decreased. Additionally, the sensitivity could also be decreased if desired.

Alternately, the signals from the radiant energy sensor can be used to adjust the process of signals from either a thermal detector or a smoke detector in response to slowly varying ambient conditions. For example, the transition from daylight to night time, which will be reflected in output signals from the radiant energy sensor can be used, in combination to alter a sample rate, sensitivity parameter, or signal processing of one or more other sensors of hazardous conditions.

The respective radiant energy sensor or sensors, smoke sensor or sensors, thermal sensor or sensors or other sensors can be distributed throughout a region and in bi-directional communication either via a wired or wireless medium with a common processor. The processor can carry out some or all of the above-described processing in response to signals from the radiant energy sensor or sensors, as well as the other hazardous condition sensors.

Figure 1B:
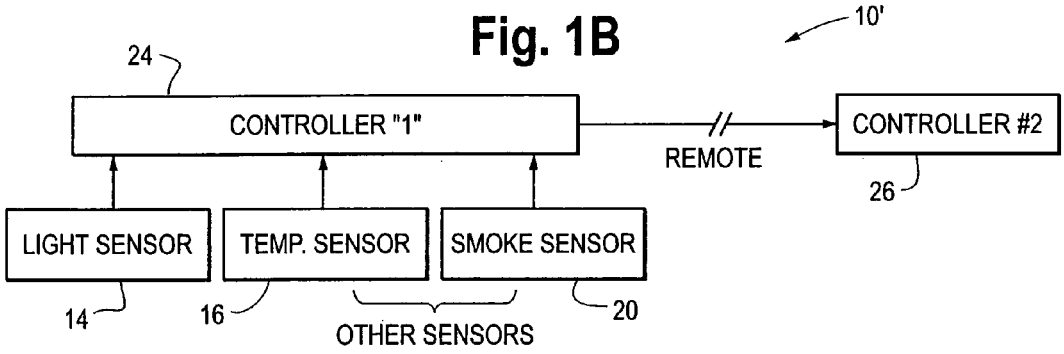
FIG. 1B is a block diagram of an alternate system in accordance with the present invention.

FIGS. 1A and 1B illustrate embodiments of the present invention. FIG. 1A, a block diagram of a system 10 in accordance with the invention includes a plurality of sensors such as a radiant energy sensor 14, a thermal sensor 16, and a smoke sensor 20. Additional identical sensors or other types of sensors 22 are indicated in phantom.

The sensors 14 through 22 can be spaced apart in a region R being monitored. They need not be in close physical proximity to one another. For example, each of the sensors 14 through 22 could be contained or carried in a respective housing and affixed to a surface in the region R. Outputs from the sensors 14 through 22 can be coupled by cables or wirelessly to a controller or microprocessor 24. The processor 24 can carry out processing, such as noted above, or described subsequently, using signals from the radiant energy sensor 14 to adjust signal values or other parameters associated with temperature sensor 16 or smoke sensor 20 all without limitation.

FIG. 1B illustrates an alternate configuration 10' which incorporates radiant energy sensor 14, thermal sensor 16, smoke sensor 20 coupled to controller 24. Controller 24 is in turn coupled by a communication link to a displaced second controller 26 which can carry out a portion of the processing noted above.

Figure 2A:
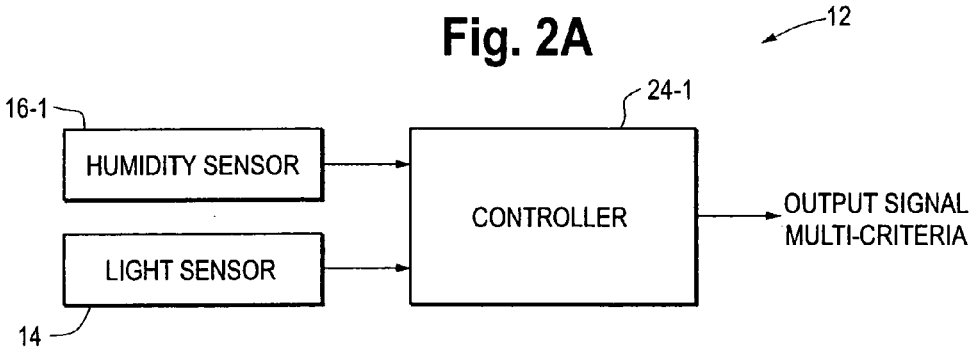
FIG. 2A is a block diagram of yet alternate system in accordance with the invention.
Figure 2B:
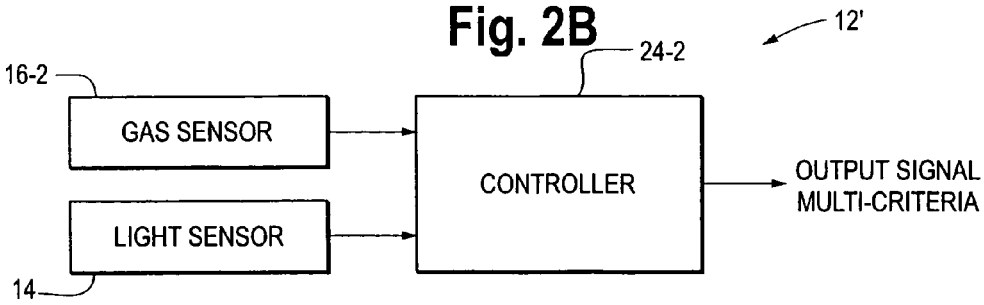
FIG. 2B is a further alternate system in accordance with the invention.

FIGS. 2A and 2B illustrate alternate embodiments 12, 12' in accordance with the invention. As illustrated in FIG. 2A, system 12 incorporates radiant energy sensor 14, and another condition sensor, humidity sensor 16-1, both of whose output signals are coupled to controller 24-1. Controller 24-1 can in turn respond to signals from radiant energy sensor 14 so as to adjust signal values or other parameters associated with humidity sensor 16-1 as described above.

FIG. 2B illustrates system 12' which incorporates as an alternate condition sensor, gas sensor 16-2. Outputs from radiant energy sensor 14 and gas sensor 16-2 can in turn be coupled to controller 24-2 for processing as described above.

Those of skill will understand that the various controllers 24, 24-1 and 24-2 could be implemented with a variety of circuit configurations without departing from the spirit and scope of the invention. For example, a combination of interconnected analog and digital circuits can be used to implement the various controllers. Alternately, a programmed processor, such as a microprocessor, could be used.

FIGS. 3A, 3B illustrate additional exemplary processing details of a method 100 in accordance with the invention. In an initial step 102 signal values are acquired from a plurality of sensors such as photon or radiant energy sensor 14, thermal sensor 16 and smoke sensor 20. In the illustrative method 100, the smoke sensor 20 is implemented as a photoelectric smoke sensor of type known to those of skill in the art.

In a step 104, the signals associated with the thermal sensor 16 are converted to a temperature or degrees. In a step 106, a change of temperature, DC from an average temperature being maintained for the region R is determined.

In a step 108, average light level in the region R is established based on signals from sensor 14. In a step 110, a change in ambient light, DL from average light level in the region R is established.

In a step 112, the radiant energy variation DL is analyzed to determine if the signal is indicative of flame. A flame indicating output F is produced thereby. Those with skill will understand that the radiant energy variations DL could be compared to a plurality of flame indicating profiles as one way of producing a flame indicating indicia F. Other types of flame analysis such as pattern recognition, neural net processing and the like all come within the spirit and scope of the invention.

In a step 114, the variation in light DL is compared to a night threshold. If the variation indicates night time, a night mode indicator is set, step 114*a*. Alternately, in a step 116 if the change in light DL exceeds a light increasing threshold, the night mode indicator is reset, step 116*a*.

In a step 118, a variation in output, DP, from the smoke sensor 20, from a running average of such signals is established. Such changes would be most likely to take place in the event of increasing smoke in the region R, which is incident upon sensor 20.

In a step 120, a nuisance bypass counter ST is decremented and clamped. In a step 122, noise is removed from the variation in smoke DP. The noise removal processing can introduce a selectable delay, for example 25 seconds, brought about by an averaging process to suppress the noise.

In a step 124, flame related signal F is compared to a threshold to determine if flames are present in the region R. If so, in a step 126 the temperature variation DC is compared to a low heat rise threshold. If the changing temperature exceeds the low heat rise threshold, processing in step 122 is revised to shorten the noise elimination delay from the larger number, 25 seconds, to shorter delays of 10 seconds.

It will be understood that the exemplary delay values of 25 seconds and 10 seconds can be varied without departing from the spirit and scope of the invention. For example, the initial noise related delay and a lower smoke environment could be set at 20 seconds or 30 seconds or other values without limitation. Similarly, the shortened noise delay of step 128 need not be 10 seconds. It could be shortened to 5 seconds or 15 seconds as most appropriate given the circumstances.

If the flame indicating indicia F does not exceed the threshold in step 124, a comparison is made in step 130 of the change in temperature signal, DC, to a high heat threshold. In the event that the heat variation DC does not exceed the high temperature threshold, another comparison is made in a step 132 of the radiant energy indicating signal L to the dark or night threshold. If the radiant energy indicating signal L is less than the dark or night threshold, the nuisance bypass counter ST is initialized at a predetermined count, step 134, FIG. 3B. If not, the status of the night mode indicator is checked, step 136, FIG. 3B.

Sensitivity can then be increased in steps 138*a* and 138*b*, FIG. 3B. In step 138*a*, the sensitivity to smoldering fires can be increased by, for example, increasing the sensitivity associated with signals from photoelectric smoke sensor, such as sensor 20. Additionally, sensitivity to flaming fires F can be increased by reducing the flame threshold, see step 124.

The variation in smoke signal, DP, is compared to a minimum smoke level step 140. If it exceeds the minimum smoke level, in a step 142, the value of the nuisance counter ST is increased.

In a step 144, the value of the nuisance counter ST, a number N, is compared to a maximum allowable value and clamped at that maximum value. In a step 146, the variation in smoke signal DT is compared to a maximum smoke level. If the signal DP is between the minimum and the maximum, an output corresponding to the value of DP is generated, step 148*a*. Alternately, in step 148*b*, the condition indicating output is set to the maximum smoke level plus the value N of the nuisance counter ST.

Where in step 140, the smoke variation value DP is less than the minimum smoke level, the nuisance counter value N is set to zero, step 142*a*. A condition indicating output indicating a lack of smoke is generated in step 150.

In a step 152, FIG. 3B, contents of the nuisance counter ST are compared to zero. If above zero, the output value, step 154 is set to the maximum smoke level plus the maximum value of N. In a step 156, the output from the above noted steps is compared to an alarm threshold. If the output value exceeds the alarm threshold, an alarm condition can be indicated in a step 158*a*. Alternately, no alarm is indicated, step 158*b*. In step 160 the nuisance value counter ST is decremented and clamped at zero.

The above methodology 100 can be repeated in the next sample interval. It will be understood that variations of the exemplary methodology 100 come within the spirit and scope of the present invention. Using radiant energy sensor 14 to alter signal values from other types of sensors such as thermal sensor 16 or smoke sensor 20 or to adjust sensitivity, parameters can be incorporated into a variety of processing methodology without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector for sensing a fire condition in a region comprising:

a light sensor in the detector which generates a first signal indicative of ambient light intensity in the region being monitored by the detector at least a fire sensor which generates a second signal indicative of a fire condition in the region; and a processor that receives the first and second signals, the processor responds to the first signal to increase a sensitivity parameter associated with the second signal such that the detector is more sensitive to the fire condition when the first signal is indicative of light in the region produced by a fire condition and where the processor further executes instructions which determine if the first signals has deviated from a time based average therefore in establishing the presence of a fire condition.

2. A detector as in claim 1 where the processor responds to a fire condition, indicated by a pattern of light intensity variations, sensed by the processor over time.

3. A detector as in claim 1 which includes a filter where the first signal comprises a filtered representation of the incident light.

4. A process comprising:

sensing incident radiant energy from a region being monitored;

sensing a different, potentially hazardous condition;

first determining if sensed radiant energy is indicative of the presence of fire, and, responsive thereto, then determining on an accelerated basis, if the sensed different condition is indicative of fire wherein the first determining includes evaluating if the sensed radiant energy has abruptly decreased, and, responsive thereto, the determining on an accelerated basis includes increasing at least one of a sensitivity parameter, a sample rate associated with sensing the different condition, or, a signal magnitude associated with the different condition.

5. A process as in claim 4 where the first determining includes evaluating the sensed radiant energy relative to at least one fire profile.

6. A process as in claim 4 where the first determining includes evaluating the sensed radiant energy relative to a plurality of fire profiles.

7. A process as in claim 4 where sensing the different condition comprises sensing at least one of heat or smoke.

8. A process as in claim 7 which includes processing at least one of heat or smoke indicia in response to a radiant energy indicating fire condition, so as to shorten a response interval in then determining if the heat or smoke indicia are indicative of fire.

9. A process as in claim 4 which includes sensing radiant energy and sensing the different condition at spaced apart locations in the region.

10. A process as in claim 9 which includes processing indicia, associated with sensing radiant energy and the different condition at least in part, at a location in the region displaced from at least one of the sensings.

11. A process as in claim 4 which includes increasing an amplitude magnitude of a signal indicative of the sensed different condition in response to the sensed radiant energy being indicative of fire.

* * * * *

UNITED STATES PATENT AND TRADEMARK OFFICE

CERTIFICATE OF CORRECTION

PATENT NO. : 7,602,304 B2
APPLICATION NO. : 11/393464
DATED : October 13, 2009
INVENTOR(S) : Lee D. Tice It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 484 days.

Signed and Sealed this

Fifth Day of October, 2010

David J. Kappos

David J. Kappos
*Director of the United States Patent and Trademark Office*